US005879190A

United States Patent [19]

Maruyama et al.

[11] Patent Number: 5,879,190

[45] **Date of Patent: *Mar. 9, 1999**

[54] COAXIAL CONNECTOR

[75] Inventors: Takashi Maruyama, Kanazawa; Toshitaka Kuriyama, Ishikawa-ken, both of Japan

[73] Assignee: Murata Manufacturing Co., Ltd., Nagaokakyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 633,112

[22] Filed: Apr. 16, 1996

[30] Foreign Application Priority Data

Apr. 18, 1995 [JP] Japan ..... 7-092464

[51] Int. Cl.[6] ..... H01R 17/18

[52] U.S. Cl. ..... 439/582; 439/63; 439/581

[58] Field of Search ..... 439/63, 581, 582

[56] References Cited

U.S. PATENT DOCUMENTS

| | | | |
|---|---|---|---|
| 4,655,534 | 4/1987 | Stursa | 439/582 |
| 4,857,014 | 8/1989 | Alf et al. | 439/578 |
| 4,881,912 | 11/1989 | Thommen et al. | 439/582 |
| 4,892,491 | 1/1990 | Budano II et al. | 439/582 |
| 5,104,325 | 4/1992 | Mitani et al. | 439/63 |
| 5,110,308 | 5/1992 | Nishikawa et al. | 439/582 |
| 5,263,877 | 11/1993 | Mitani | 439/582 |
| 5,316,499 | 5/1994 | Scannelli et al. | 439/582 |
| 5,569,049 | 10/1996 | Tatebe et al. | 439/582 |

FOREIGN PATENT DOCUMENTS 44 10 072 A1 9/1994 Germany .

*Primary Examiner*—J. J. Swann

*Attorney, Agent, or Firm*—Burns, Doane, Swecker & Mathis, LLP

[57] ABSTRACT

The invention provides a coaxial connector wherein a bushing can be mounted to a housing more easily, poor pressure resistance and characteristic impedance due to socket displacement can be eliminated, and deformation of the front end of the socket can be prevented. The coaxial connector of the invention includes projections along the outer periphery of the bushing, and cutouts in the housing. The bushing has a cover that covers the upper portion of the socket. In addition, the bushing has a tapered intermediate portion between its base portion and its front end. The bushing is positioned around the axis, and displacement of the mounting position of the socket to the bushing and deformation of the front end of the socket are prevented.

12 Claims, 6 Drawing Sheets

COAXIAL CONNECTOR

BACKGROUND OF THE INVENTION

1. Field of the Invention

The present invention broadly relates to a coaxial connector and, more particularly, to a small coaxial connector used, for example, as a component part of a portable communication device.

2. Description of the Related Art

A description will now be given of the construction of a conventional coaxial connector, with reference to FIGS. 7 and 8.

Referring to FIG. 7, the conventional coaxial connector comprises a metallic housing 71, a socket 73, and a bushing 72. The housing 71 includes a cylindrical portion 74 which comes into contact with the outer conductor portion of a receptacle (not shown in FIG. 7), a cover 75 for covering an upper opening of the cylindrical portion 74, and a crimping portion 76 for gripping an outer conductor portion 78*a* of a coaxial cable 77 to grip the outer conductor portion 78*a*. The insulating bushing 72 is accommodated in the cylindrical portion 74 of the housing 71, and the socket 73 which comes into contact with the central conductor portion 78*b* of the receptacle is held by the bushing 72. The central conductor portion 78 of the coaxial cable 77 is connected to the socket 73.

FIG. 8 is a perspective view of the bushing 72 of FIG. 7, in which a socket 73 is fitted into a hole 80 formed in the bushing 72 at its central axis. As illustrated in FIG. 7, a plurality of pawls 79 extend radially outward from the socket 73, which engage the bushing 72 to prevent the socket 73 from being removed from the hole 80.

Such a conventional coaxial connector has the following problems. A cutout needs to be formed in the bushing 72 which is mounted into the housing 71 in order to insert the front end of the coaxial cable, as illustrated in FIG. 8. The coaxial cable must be mounted in the housing 71, with the cutout facing the direction of the extension of the coaxial cable. This, however, is difficult to accomplish because the bushing 72 tends to rotate around the axis.

Carelessness when fitting the socket 73 into the bushing 72 or when mounting a completed coaxial connector into the receptacle causes an abnormally high upward stress to be exerted onto the socket 73, displacing the socket 73 upward from the predetermined position. This results in a smaller distance between the socket 73 and the cover 75 of the housing 71. A smaller distance may lead to poor pressure resistance and characteristic impedance.

In addition, since the socket 73 projects below from the bottom face of the bushing 72, the front end of the socket 73 has a tendency to deform due to external forces exerted thereto during mounting of the coaxial connector into the receptacle or the like. This problem might be overcome by increasing the height of the bushing 72 so that the socket 73 does not protrude from the bottom face of the bushing 72. This, however, cannot be done because the lower portion of the bushing 72 is tapered to allow the cylindrical portion 74 of the housing 71 to be pressed inward in order to let the cylindrical portion 74 deform, as it comes into contact with the outer conductor portion of the receptacle to be mounted therein. Accordingly, when the height of the bushing 72 is increased, as mentioned above, the lower portion of the bushing 72 becomes thinner, thus making it difficult to form the bushing 72 when producing a smaller coaxial connector.

SUMMARY OF THE INVENTION

Accordingly, an object of the present invention is to provide a coaxial connector in which the bushing can be easily mounted to the housing.

Another object of the present invention is to provide a coaxial connector which makes it possible to eliminate the problem of poor pressure resistance and characteristic impedance resulting from socket displacement.

A further object of the present invention is to provide a coaxial connector which makes it possible to prevent deformation of the front end of the socket.

In a first aspect of the present invention, in order to facilitate positioning around the axis when mounting the bushing to the housing, projections are formed along the outer periphery of the bushing, and cutouts for engaging the projections of the bushings are formed along the periphery of the cylindrical portion of the housing. When the bushing is being mounted to the housing, the projections of the bushing engage the cutouts of the housing to thereby position the bushing around the axis.

In a second aspect of the present invention, in order to prevent displacement of the mounting position of the socket to the bushing, the bushing is provided with a cover which covers holes in the bushing, while the socket is being held by the bushing. The cover of the bushing covers the upper portion of the socket in order to hold the socket in position.

To limit the amount of projection of the socket from the bushing, in a third aspect of the present invention, the front end of the bushing in the direction of which the bushing is inserted into the housing is such as to extend up to the region around the end of the socket. In addition, the outer periphery of the front end can be made smaller than the outer periphery of the base portion to form a tapered intermediate portion between the front end of the bushing and the base portion. Since only the intermediate portion of the bushing is tapered, the length of the bushing in the axial direction can be made long, without having to make the lower end of the bushing extremely thin, so that it is possible to limit the projection amount of the socket from the bushing even for a small coaxial connector.

According to the coaxial connector of the first aspect of the present invention, when mounting a bushing to a housing, the projections of the bushing engage the cutouts of the housing to thereby position the bushing around the axis, so that the bushing can be mounted to the housing more easily.

According to the coaxial connector of the second aspect of the present invention, the cover of the bushing covers the upper portion of the socket in the bushing in order to hold the socket in position, thus preventing displacement of the mounting position of the socket to the bushing.

According to the coaxial connector of the third aspect of the present invention, since only the intermediate portion of the bushing is tapered, the projection amount of the socket from the bushing can be limited in length even for a small coaxial connector, without having to considerably decrease the thickness of the lower end of the bushing when it is made long in the axial direction, so that it is possible to prevent deformation of the front end of the socket.

DESCRIPTION OF THE PREFERRED EMBODIMENTS

A description will now be given of the constructions of the coaxial connectors of the preferred embodiments of the present invention, with reference to FIGS. 1 to 6.

Figure 1:
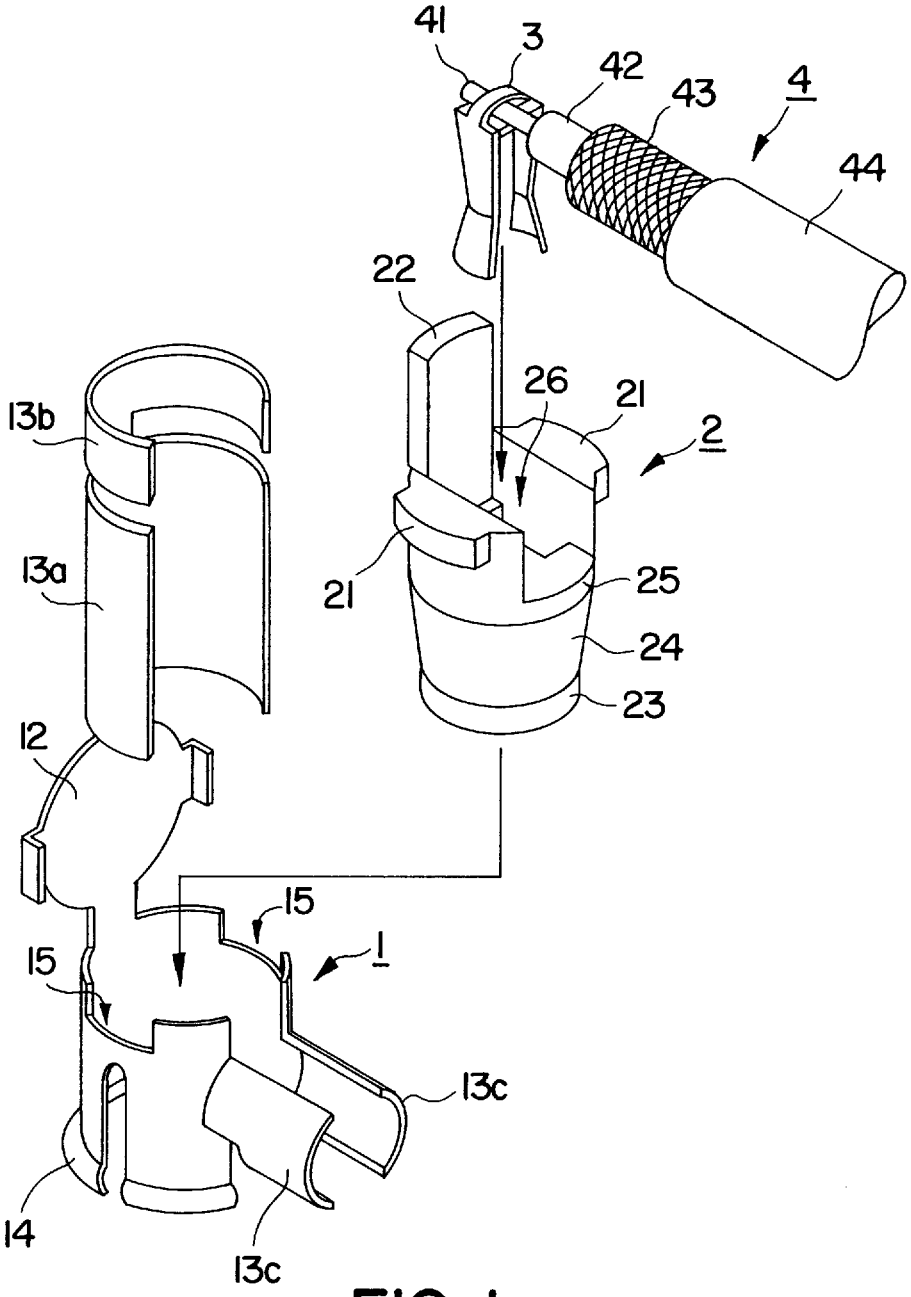
FIG. 1 is an exploded perspective view of the component parts of a coaxial connector of a first embodiment of the present invention.

FIG. 1 is an exploded perspective view of the component parts of a coaxial connector. Referring to FIG. 1, reference numeral 1 denotes a metallic housing formed by punching, and bending and holding a metal sheet; reference numeral 2 denotes a bushing made of insulating synthetic resin; and reference numeral 3 denotes a socket formed by punching, and bending and folding a metal sheet. The housing 1 includes a cylindrical portion 14 which comes into contact with the outer conductor portion of a receptacle (not shown in FIG. 1), a cover 12 for covering the upper opening of the cylindrical portion 14, and crimping portions 13*a*, 13*b*, and 13*c* for crimping to a coaxial cable to grip the cable. Cutouts 15, 15 are formed in the upper periphery of the cylindrical portion 14. Additional cutouts are formed in the lower periphery of the cylindrical portion 14 to permit the cylindrical portion 14 to be is pressed inward when it is inserted into a receptacle. Protrusions 21, 21 which engage in the cutouts 15, 15 of the housing 1 are provided at the outer periphery of the bushing 2.

As used herein, "cylindrical" is to be given its mathematical definition as a surface generated by a straight line which moves so that it always intersects a given plane (directrix) and remains parallel to a fixed line that intersects the plane of the directrix. This includes circular cylinders, quadric cylinders, elliptic cylinders, parabolic cylinders, hyperbolic cylinders, as well as cylinders whose directrix and right sections are polygons.

In addition, the bushing 2 has a cover 22 for covering central holes 26 in the bushing 2 for holding the socket 3. Further, the bushing 2 has a front end portion 23 in the direction of which the bushing 2 is inserted to the housing 1 with an outer periphery thereof being smaller than the outer periphery of a central base portion 25 in the bushing 2, thereby forming a tapering intermediate portion 24 located between the base portion 25 and the front end portion 23. The socket 3 is constructed so as to allow for insertion of a center conductor portion 41 of a coaxial cable 4 into it.

Figure 2A:
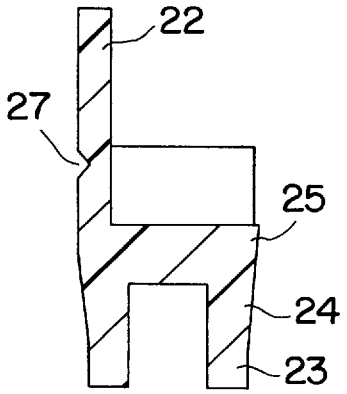
FIGS. 2*a*–2*e* illustrate the construction of a bushing used in the coaxial connector of the first embodiment of the present invention shown in FIG. 1.
Figure 2B:
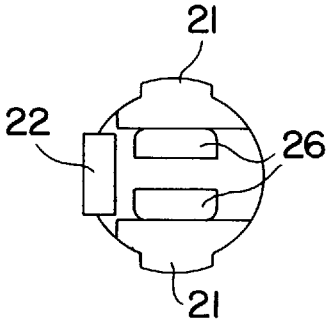
Figure 2C:
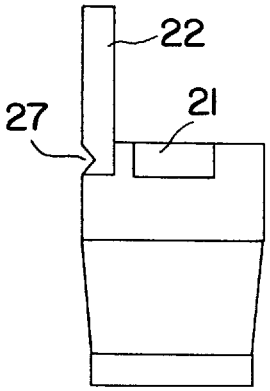
Figure 2D:
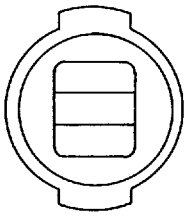
Figure 2E:
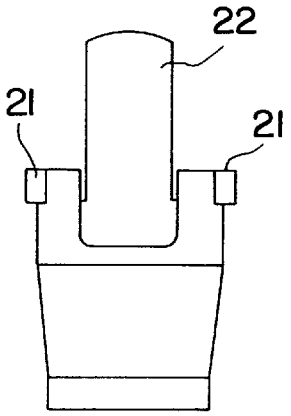

FIGS. 2*a*, 2*b*, 2*c*, 2*d*, and 2*e* are illustrations of the construction of the bushing 2 of FIG. 1. More specifically, FIG. 2*a* is a cross-sectional view of the construction in a plane passing through the central axis of the cover 22 and the bushing 2. FIGS. 2*b*, 2*c*, 2*d*, and 2*e* are a top view, a front view, a bottom view, and a right side view of the construction, respectively. As illustrated in FIGS. 2*a* to 2*e*, a wedge-shaped cutout 27 is formed in the base portion of the cover 22 so as to allow the cover 22 to bend at the wedge-shaped cutout 27. Two holes 26 are provided in the central part of the bushing 2 for inserting, respectively, two electrodes of the socket 3 of FIG. 1 so that the two electrodes step over the holes.

Figure 3A:
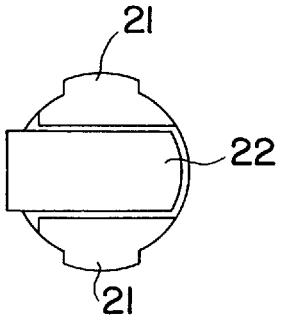
FIGS. 3*a*–3*c* illustrate the construction of the bushing used in the coaxial connector of the first embodiment of the present invention shown in FIG. 1.
Figure 3B:
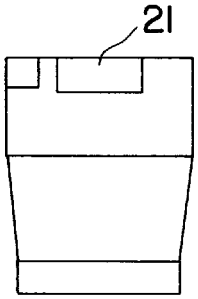
Figure 3C:
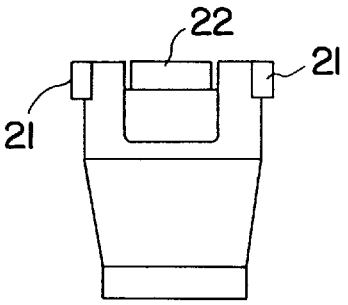

FIGS. 3*a*, 3*b*, and 3*c* are a top view, a front view, and a right side view of the construction of the bushing 2, with the holes being covered by the cover 22. As illustrated in the figures, the upper side of the bushing 2 is made substantially level or co-planar when the cover 22 is bent over to cover the holes 26, and the cover 12 of the housing 1 covers the upper portion of the bushing 2.

Figure 4:
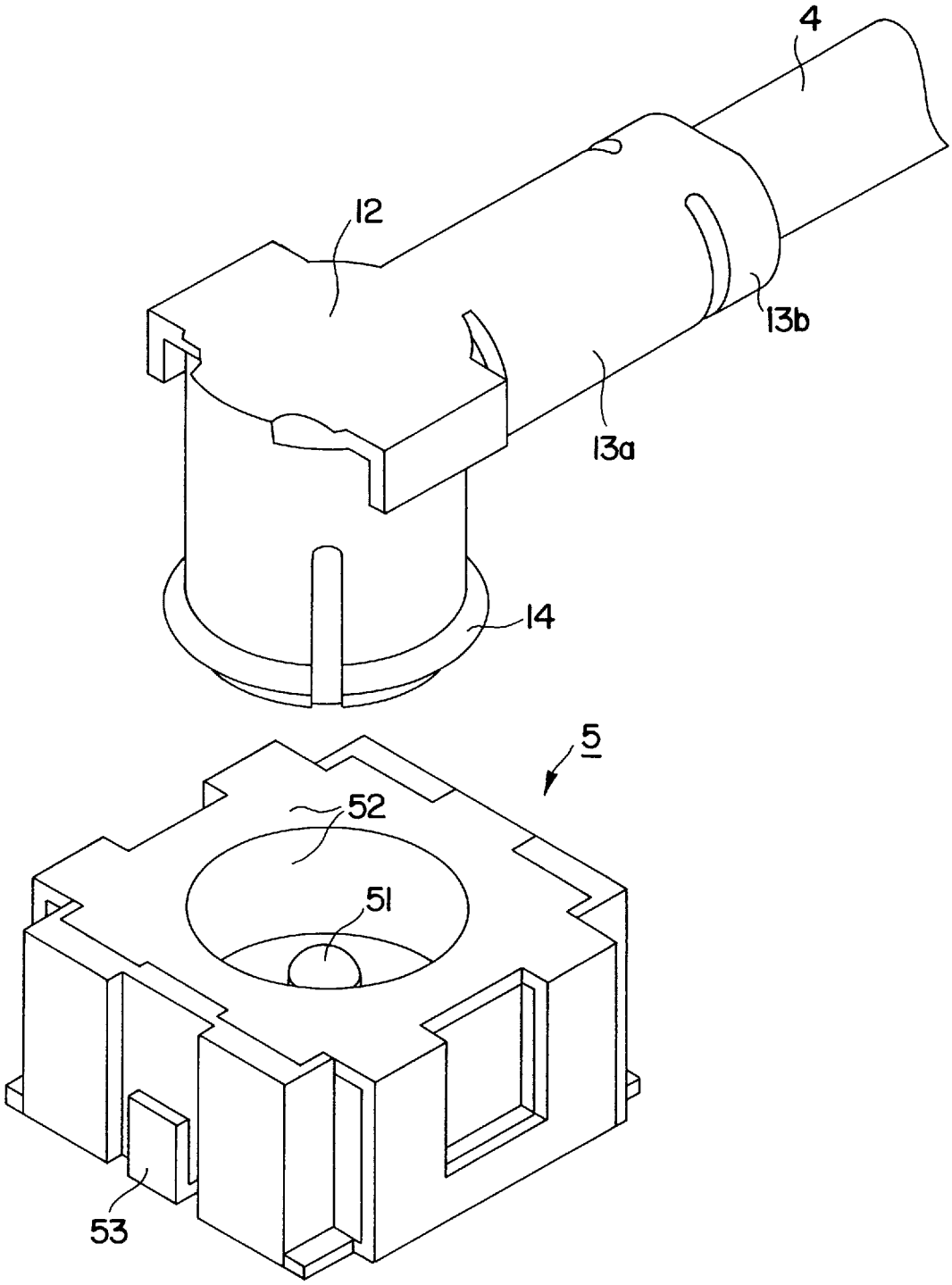
FIG. 4 is a perspective view of a receptacle in relation to the coaxial connector.

FIG. 4 is a perspective view of a coaxial connector having a coaxial cable mounted thereto in relation to a receptacle. Referring to FIG. 4, reference numeral 5 denotes a receptacle which is mounted onto a circuit substrate or the like. The receptacle S includes a central conductor portion 51, an outer conductor portion 52, and a leading terminal 53 of the central conductor portion 51.

Figure 5A:
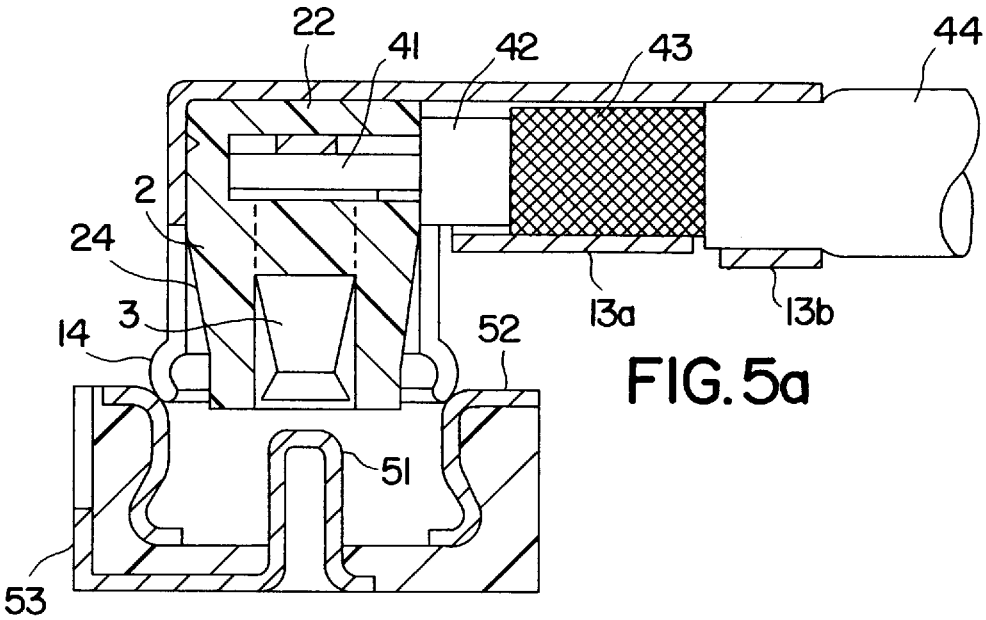
FIGS. 5*a*–5*c* are a cross sectional views of the coaxial connector which is being mounted into the receptacle.
Figure 5B:
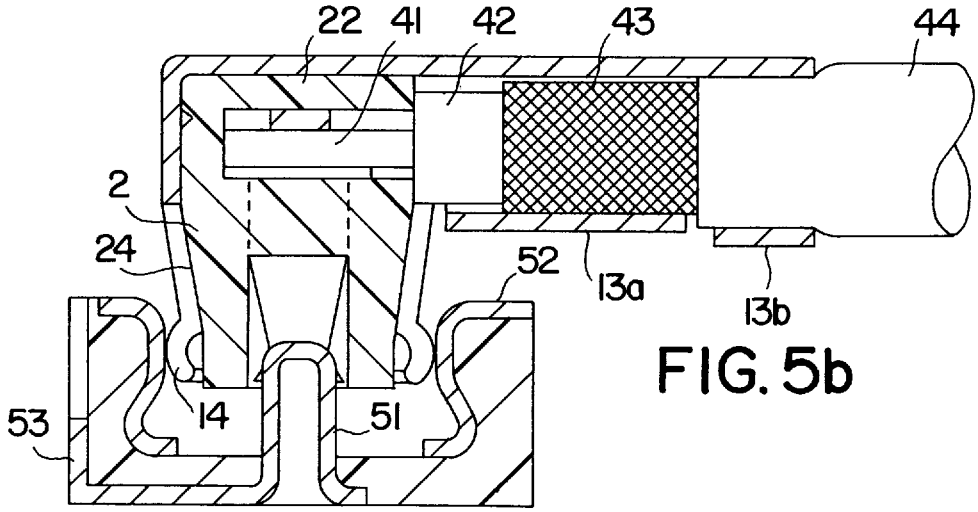
Figure 5C:
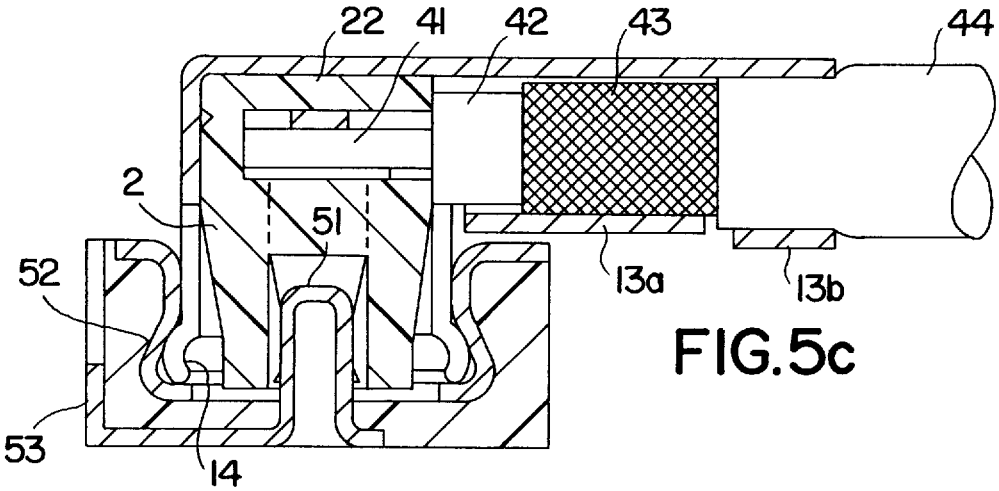

FIGS. 5*a*, 5*b*, and 5*c* are cross-sectional views of the coaxial cable being mounted to the coaxial connector and the coaxial connector being mounted into the receptacle. Referring to the figures, reference numeral 41 denotes a central conductor portion of the coaxial cable, reference numeral 42 denotes an insulation portion; reference numeral 43 denotes an outer conductor portion; and reference numeral 44 denotes an outer sheath. As illustrated in the figures, the central conductor portion 41 of the coaxial cable and the outer conductor portion 43 of the coaxial cable are electrically connected to the socket 3 and the crimping portion 13*a* of the housing 1, respectively.

In inserting such a coaxial connector with a coaxial cable connected thereto into the receptacle 5, the cylindrical portion 14 of the housing 1 is pressed inward, as shown in FIGS. 5*a* and 5*b*. During the insertion, the bushing 2 does not interfere with the socket 3 because the bushing 2 has a tapered portion 24. When the coaxial connector is further pushed into the receptacle 5, the cylindrical portion 14 of the housing 1 widens due to its resiliency, resulting in engagement with the outer conductor portion 52 of the receptacle 5. When this occurs, the socket 3 comes into contact with the central conductor portion 51 of the receptacle 5.

Figure 6:
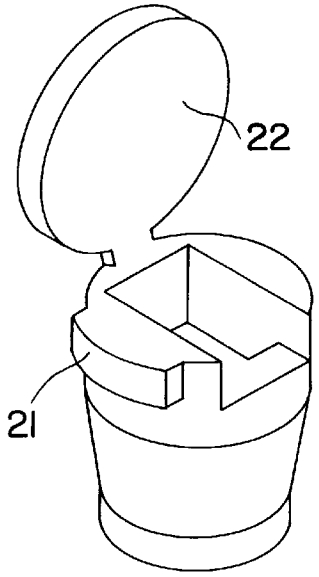
FIG. 6 is a perspective view of a form of the bushing used in a coaxial connector of a second embodiment of the present invention.
Figure 7:
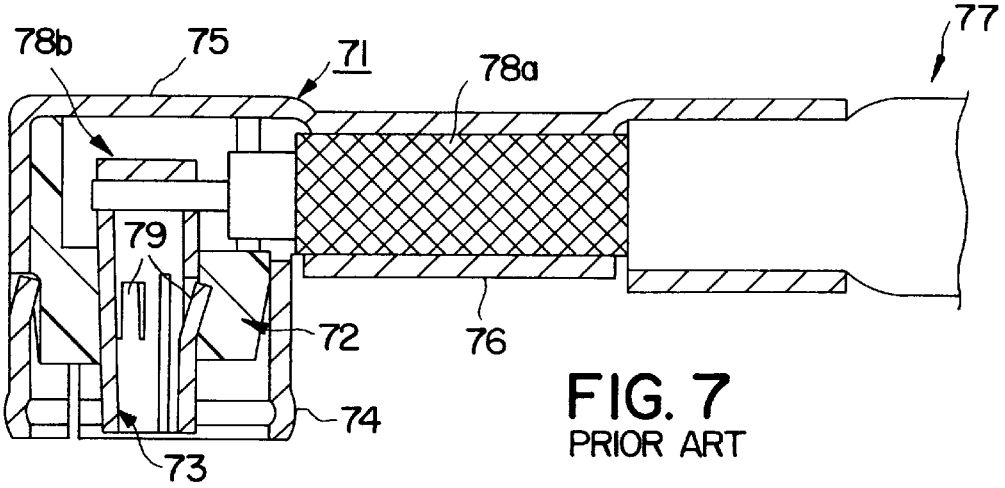
FIG. 7 PRIOR ART
FIG. 7 is a cross-sectional view of the construction of a conventional coaxial connector.
Figure 8:
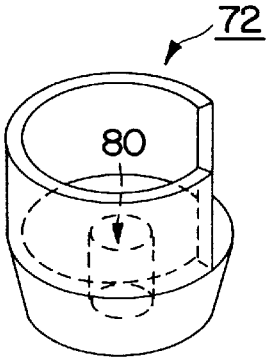
FIG. 8 PRIOR ART
FIG. 8 is a perspective view of the construction of a bushing used in the conventional coaxial connector.

FIG. 6 illustrates an example of another bushing having a different form. As described above, the bushing 2 illustrated in FIG. 1 or the like has two projections 21, 21 disposed opposite each other with respect to the central axis being the central line, while the two projections 21, 21 are engaging the cutouts of the housing 1. The bushing 2 of FIG. 6, however, only needs to have at least one projection portion 21. In addition, the cover 22 may be formed to have cylindrical sides and so as to cover the entire upper portion of the bushing 2, as illustrated in FIG. 6, although in the bushing 2 of FIG. 1 the cover 22 was formed so as to cover only the holes 26 of the bushing 2.

According to the coaxial connector of the first aspect of the present invention, when mounting the bushing 2 to the housing 1, the projections 21, 21 of the bushing 2 engage the cutouts 15, 15 of the housing 1 to thereby position the bushing 2 around the axis, so that the bushing 2 can be mounted to the housing 1 far more easily.

According to the coaxial connector of the second aspect of the present invention, the cover 22 of the bushing 2 covers the upper portion of the socket 3 in order to hold the socket 3 in position, thereby preventing poor pressure resistance and characteristic impedance due to displacement of the mounting position of the socket 3 to the bushing 2.

According to the coaxial connector of the third aspect of the present invention, since only the intermediate portion 24 of the bushing 2 is tapered, it is possible to limit the amount of projection of the socket 3 from the bushing 2 even for a small coaxial connector, without having to considerably decrease the thickness of the lower end of the bushing 2 when it is made long along the axial direction, so that deformation of the front end of the socket 3 can be prevented.

The present invention has been describe by way of exemplary embodiments to which the present invention is not limited. The scope of the invention is to be determined by reference to the claims appended hereto.

What is claimed is:

1. A coaxial connector comprising:

a metallic housing including a cylindrical portion which comes into contact with an outer conductor portion of a receptacle and includes at least one cutout at a top portion thereof, a housing cover for covering an upper opening of said cylindrical portion, and a crimping portion for gripping at least an outer conductor portion of a coaxial cable wherein said cylindrical portion, said housing cover, and said crimping portion are integral with one another;

a socket for electrically connecting to a central conductor portion of said coaxial cable and which comes into contact with a central conductor portion of said receptacle; and an insulating bushing having holes for holding said socket at a central axis of said bushing, said bushing being mounted in said cylindrical portion of said housing.

wherein said bushing has a bushing cover for covering said holes in said bushing, wherein an outer periphery of a base portion of said insulating bushing substantially contacts an inner periphery of said cylindrical portion of said metallic housing, and wherein a front end of said bushing in a direction in which said bushing is inserted into said housing extends up to an end of said socket, and an outer periphery of said front end is smaller than an outer periphery of a base portion of said cylindrical portion of said housing, a tapered intermediate portion interconnecting said front end and a bushing base portion of said bushing which is adjacent said central conductor;

wherein at least one projection not adapted to retain any portion of said coaxial cable projects from an outer periphery of said bushing, and said at least one cutout of said metallic housing engages two sides of said at least one projection is formed along a periphery of said cylindrical portion of said housing to prevent rotation.

2. A coaxial connector according to claim 1, wherein said bushing has two projections formed along said outer periphery of said bushing, and said cylindrical portion has two cutouts for engaging said two projections formed along said periphery of said cylindrical portion of said housing.

3. A coaxial connector according to claim 1, wherein said bushing cover has parallel sides and, when covering said holes in said bushing, said bushing cover is coplanar to a top surface of said outer periphery of said bushing.

4. A coaxial connector according to claim 3, wherein said bushing cover includes a wedge-shaped cutout in a base portion of said bushing cover.

5. A coaxial connector according to claim 1, wherein said bushing cover has a cylindrical side and, when covering said holes in said bushing, covers a top surface of said outer periphery of said bushing.

6. A coaxial connector according to claim 2, wherein said bushing cover has parallel sides and, when covering said holes in said bushing, said cover is co-planar to a top surface of said outer periphery of said bushing.

7. A coaxial connector according to claim 6, wherein said bushing cover includes a wedge-shaped cutout in a base portion of said bushing cover.

8. A coaxial connector according to claim 2, wherein said bushing cover has a cylindrical sides and, when covering said holes in said bushing, covers a top surface of said outer periphery of said bushing.

9. A coaxial connector according to claim 1, wherein said bushing has two holes for holding said socket at said central axis and wherein said socket has two electrode portions, each of said respective electrode portions being inserted in a respective hole of said bushing.

10. A coaxial connector according to claim 4, wherein said socket has a U-shaped cross-section extending into each hole of said bushing and over a surface of said bushing extending between said holes.

11. A coaxial connector according to claim 2, wherein said bushing has two holes for holding said socket at said central axis and wherein said socket has two electrode portions, each of said respective electrode portions being inserted in a respective hole of said bushing.

12. A coaxial connector according to claim 11, wherein said socket has a U-shaped cross-section extending into each hole of said bushing and over a surface of said bushing extending between said holes.

* * * * *